United States Patent [19]

Marks et al.

[11] Patent Number: 4,830,620

[45] **Date of Patent: * May 16, 1989**

[54] ELECTRICAL CONNECTOR

[76] Inventors: Daniel W. Marks, 2649 SW. 17th Pl., Gresham, Oreg. 97080; Richard Schmachtenberg, III, 6915 SW. 179th Ave., Beaverton, Oreg. 97007

[ * ] Notice: The portion of the term of this patent subsequent to Feb. 23, 2005 has been disclaimed.

[21] Appl. No.: 109,184

[22] Filed: Oct. 15, 1987

Related U.S. Application Data

[63] Continuation of Ser. No. 921,764, Oct. 21, 1986, Pat. No. 4,726,774.

[51] Int. Cl.[4] ..... H01R 29/00

[52] U.S. Cl. ..... 439/45; 439/75

[58] Field of Search ..... 439/44–48, 439/65, 66, 74, 75, 626, 676; 200/6 R, 6 C, 8 R, 8 A, 11 A, 51.07, 51.09, 51.1, 156, 243

[56] References Cited

U.S. PATENT DOCUMENTS

| | | | |
|---|---|---|---|
| 3,120,585 | 2/1964 | Harris, Jr. et al. | 200/156 |
| 3,627,942 | 12/1971 | Bobb | 200/51.07 |
| 4,487,463 | 12/1984 | Tillotson | 339/17 |
| 4,654,472 | 3/1987 | Goldfarb | 174/52 R |

*Primary Examiner*—Neil Abrams

*Attorney, Agent, or Firm*—Dellett, Smith-Hill and Bedell

[57] ABSTRACT

An electrical connector comprises four conductor elements each having a surface portion which is spaced from, but presented towards, a first axis. The surface portions are equiangularly distributed about the first axis and are substantially equidistant from the first axis. Each conductor element extends at least partly between first and second planes which are perpendicular to the first axis. A rod structure has a central axis, the rod structure comprises four elongate bodies of conductive material which are supported in mutually electrically insulated relationship. The bodies of conductive material are substantially parallel to each other and substantially equiangularly distributed about the central axis of the rod structure and substantially equidistant therefrom. The rod structure and the conductor elements are positionable so that the central axis of the rod structure substantially coincides with the first axis, and are such that when they are so positioned and the rod structure extends through the first and second planes, the bodies of conductive material engage the surface portions of the conductor elements respectively.

19 Claims, 5 Drawing Sheets

ELECTRICAL CONNECTOR

CROSS-REFERENCE TO RELATED APPLICATION

This is a continuation-in-part of copending Patent Application Ser. No. 06/921,764 filed Oct. 21, 1986, now Pat. No. 4,726,774 issued Feb. 23, 1988.

This invention relates to an electrical connector.

BACKGROUND OF THE INVENTION

Electrical connectors that are currently used for connecting conductor runs of a circuit board to other electrical apparatus, e.g., by way of electrical conductor runs of other circuit boards or a ribbon cable, are generally composed of a plug component and a socket component. Each component comprises a body of dielectric material which carries a multiplicity of conductor elements. When the two components are brought into mating relationship, the conductor elements of the plug component engage respective conductor elements of the socket component.

It has hitherto been conventional to mount electronic devices in so-called duel in-line packages. The dual in-line package, or DIP, has connection pins that are connected to the electronic device and are used for mounting the DIP to a circuit board. In particular, holes are drilled in the board and the pins are fitted in the holes. The physical properties of the board material and the limitations of drilling machines have made it conventional for the holes to be drilled at 1.27 mm (0.050 inch) centers. The spacing between the pins imposes a limit on the number of DIPs that can be accommodated by a circuit board of a given size, and consequently limits the number of connections required between the circuit board and other electrical apparatus.

The demand for connection capacity to a circuit board carrying DIPs can generally be met using connectors having conductor elements at 1.27 mm centers: the number of connections is not so large that the space required for the connector limits to a significant extent the area available for DIPs. However, surface mounted devices do not have connection pins that require drilling of circuit boards, and therefore the connection pads of an SMD can be at less than 1.27 mm centers and it is conventional for the connection pads to be at 0.635 mm (0.025 inch) centers. Proposals have been made to place the pads of SMDs even closer, at 0.58 mm (0.020 inch) centers. Such close spacing of the connection pads means that more SMDs than DIPs can be accommodated by a board of a given size, and therefore the demand for connection capacity is much greater for SMDs than for DIPs. It is in fact being found increasingly that the space required for connectors is limiting the area available for SMDs.

It has been proposed that the conventional plug/-socket connector be modified so that the spacing between the conductor elements is reduced, e.g., to 0.635 mm. However, in order to maintain adequate space between the conductor elements, it becomes necessary to reduce the width of the conductor elements, and the conductor elements are then liable to be bent or damaged through handling and bringing the connector components into mating relationship.

U.S. Pat. No. 840,537 (Weir) discloses a switchboard composed of a pair of parallel boards, each of which is formed with a square array of apertures. The two arrays are aligned, and each aperture contains a metal ring.

The ring of one board is connected to the corresponding ring of the other board by inserting a conductive plug through the rings.

U.S. Pat. No. 3,223,956 (Dufendach et al) discloses an instruction apparatus that is somewhat similar to the switchboard of Patent No. 840,537, except that it comprises four boards, and a detent is associated with each set of four aligned apertures for establishing two possible insertion positions of the plug or pin that is fitted in the aligned apertures. The pin comprises a core of dielectric material having four equiangularly spaced longitudinal grooves, and metallic spring contacts fitted in these grooves. In one insertion position of the pin, one pair of spring contacts provides electrical connection between two of the boards, and in the other insertion position the other pair of contacts provides electrical connection between the other two boards.

U.S. Pat. No. 3,246,208 (Lex et al) discloses a programming pin board comprising a group of parallel input strips and a group of parallel output strips. The input strips and output strips carry conductor runs. The two groups of strips are arranged in a criss-cross array, and at each crossing point a connection between an input strip and an output strip may be provided by means of a plug having four prongs. The plug is applied to the input and output strips so that one prong is received in each quadrant defined at the crossing point of the input strip and the output strip. Selected prongs have a conductive coating, while the surface layers of the other prongs are electrically insulating. Thus, the conductor runs that are interconnected at the crossing point depend on which prongs have conductive coatings.

U.S. Pat. No. 3,258,730 (Husband et al) discloses a switch block comprising an encapsulating body of dielectric material in which conductive bars are embedded. Holes pass through the dielectric block and the bars so that terminal pins may be inserted to make selective contact between the bars.

U.S. Pat. No. 3,349,361 (Cartelli) discloses a matrix switch in which each deck comprises a board of dielectric material formed with apertures that are partially aligned with apertures in another board, and metal strips that pass through the apertures. Connection between the decks is provided by inserting a metal pin through two partially aligned apertures so as to contact the strips that cross those apertures.

U.S. Pat. No. 3,396,358 (Ballard et al) discloses a connecting matrix structure in which an elongate pin shank carries a plurality of longitudinally spaced leaf-spring contacts.

British Pat. No. 953,225 (Longford) discloses a switching matrix in which the plug is made of dielectric material and has ferrules spaced apart along its length and internally connected to conductors that project from the plug.

SUMMARY OF THE INVENTION

A preferred embodiment of the present invention is an electrical connector comprising means defining a passageway, a conductor element having a surface portion that is spaced from, but presented towards, the central axis of the passageway, and a composite rod of dielectric material and conductive material. The rod comprises an elongate core of dielectric material and an elongate body of conductive material secured to and extending lengthwise of the core. The rod can be inserted into the passageway along the central axis of the passageway. When the rod is fitted in the passageway, the body of conductive material engages the surface portion of the conductor element, so that electrically-conductive contact is established between the conductor element and the body of conductive material.

BRIEF DESCRIPTION OF THE DRAWINGS

For a better understanding of the invention, and to show how the same may be carried into effect, reference will now be made, by way of example, to the accompanying drawings in which.

DETAILED DESCRIPTION

Figure 1:
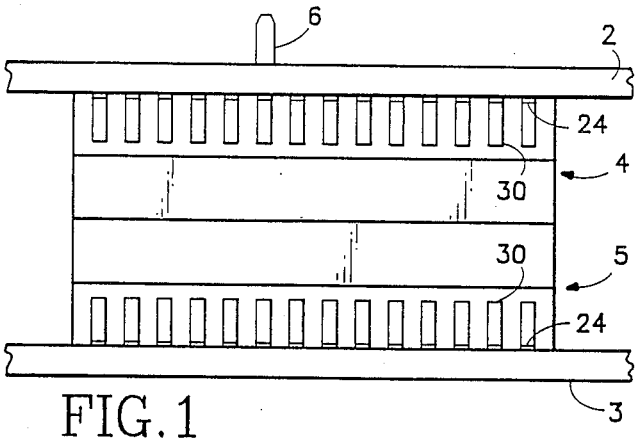
FIG. 1 is a partial side view of a connector embodying the present invention, being used to connect printed circuit boards.

FIG. 1 illustrates first and second circuit boards 2 and 3 carrying respective connector components 4 and 5. The connector components 4 and 5 are connected to conductor runs of the circuit boards 2 and 3 respectively. Composite rods 6, of which only one is shown in FIG. 1, extend through the connector components and provide electrical connection between the connector components. Consequently, the conductor runs of the two circuit boards are interconnected.

Figure 2:
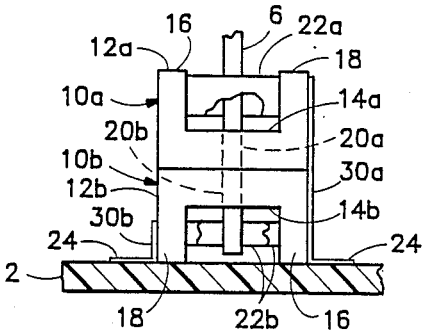
FIG. 2 is an end view, partially in section, of a major component of the FIG. 1 connector.

Each connector component shown in FIG. 1, for example the connector component 4, comprises a pair of connector assemblies 10*a* and 10*b* (FIG. 2). Each connector assembly comprises a channel section body 12 of dielectric material, having a base 14 and two side walls 16 and 18. Square holes 20 are formed in the base 14. Metal blades 22 extend diagonally across the channel defined between the side walls 16 and 18. Each blade has one end anchored in the side wall 16 and its other end extending through the side wall 18 and connected to a leg 30. The leg extends adjacent the side wall 18, perpendicular to the general plane of the base 14, and terminates in a connector pad 24. The spacing between the blades 22, in the longitudinal direction of the channel, is equal to half the spacing between the centers of the holes 20. The length of the diagonal of each hole 20 is slightly greater than the perpendicular distance between adjacent blades 22.

Figure 3:
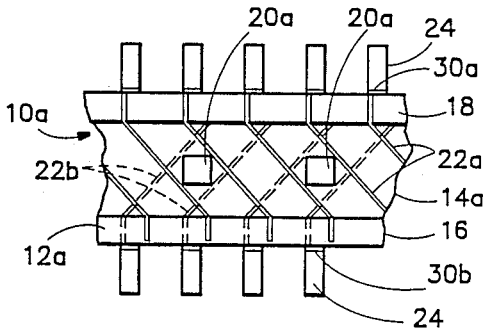
FIG. 3 is a top plan view of the component shown in FIG. 2.

The assemblies 10*a* and 10*b* are essentially identical, except that the leg 30a is longer than the leg 30*b*, and the legs 30*a* and 30*b* extend in opposite directions relative to the bases 14a and 14*b* of the respective channel section bodies 12*a* and 12*b*. Consequently, when the two assemblies 10*a* and 10*b* are positioned as shown in FIG. 2, with the channel bases 14 in confronting relationship, the connection pads of the two assemblies lie at essentially the same level. In this position, the two sets of blades are in crossing relationship, as shown in FIG. 3, and the holes 20*a* of the body 12*a* are aligned with the holes 20*b* of the body 12*b*. Each pair of aligned holes 20*a* and 20*b* defines a square-section passageway through the connector component 4. Two blades 22*a* encroach on diagonally opposite corners of the passageway within the channel defined by the body 12*a*, and two blades 22*b* encroach on the other two corners of the passageway within the channel defined by the body 12*b*.

Figure 4:
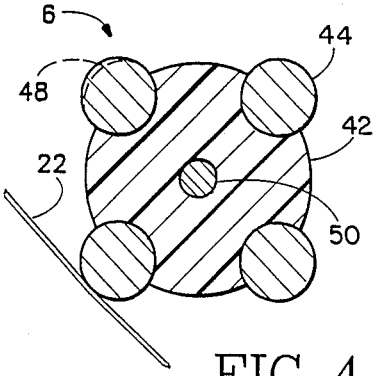
FIG. 4 is a cross-sectional view of an interconnect component of the FIG. 1 connector.
Figure 5:
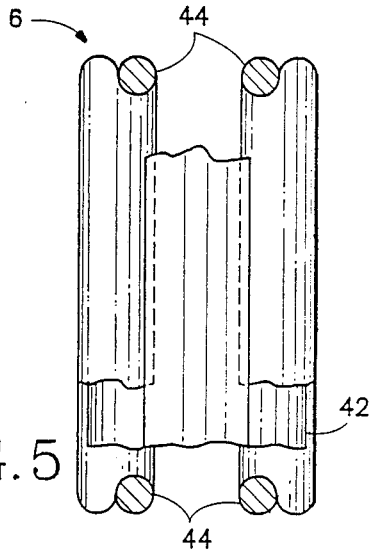
FIG. 5 is a partial side elevation, partly cut away, of the FIG. 4 component.

The composite rod 6 is shown in FIGS. 4 and 5. This rod comprises a core 42 of dielectric material, for example the polyethylene terephthalate that is sold under the registered trademark Rynite, and four pins 44 of electrically conductive wire, e.g., beryllium copper, that are bonded to the core and are equiangularly distributed about the central axis of the core structure. The rod 6 is sized to fit snugly in two aligned holes 20*a* and 20*b*, so that it cannot rotate within the holes, and is somewhat pointed in order to facilitate insertion in the holes. When the rod is fitted in the holes, the four pins 44 respectively engage the four blades 22 that encroach on the corners of the passageway defined by the aligned holes 20 and deflect the blades from the planar form illustrated in FIGS. 2 and 3, and a firm, electrically-conductive pressure contact between the blades and the pins results. When two connector components 4 and 5 are used in conjunction and the rod 6 extends through a pair of holes of each component, the blades 22 of the component 4 are connected to respective blades of the component 5.

Because the pins 44 cause the blades 22 to be deflected from their planar form, the contact between a pin and the associated blade is not confined to a line parallel to the rod 6 but is a strip that extends partly about the periphery of the pin. The contact area may be further enlarged by giving each pin a zone of increased radius of curvature, as shown by the dashed line 48 in FIG. 4.

By using each rod 6 to provide connections between four pairs of blades 22, and by dividing the blades of each connector component 4 and 5 between two connector assemblies, it is possible to provide the connector pads at an effective pitch of 0.635 mm with respect to the longitudinal direction of the channel-section bodies yet maintain the actual pitch of the rods 6 at 2.54 mm. The composite structure of the rod 6 ensures that the pins 44 are adequately supported. If additional stiffness is needed, a steel pin 50 (FIG. 4) may be provided at the center of the core. The rod may be manufactured by extrusion of dielectric material through a die in which the pins 44 (and the pin 50 if provided) are supported at their desired respective positions.

Figure 6:
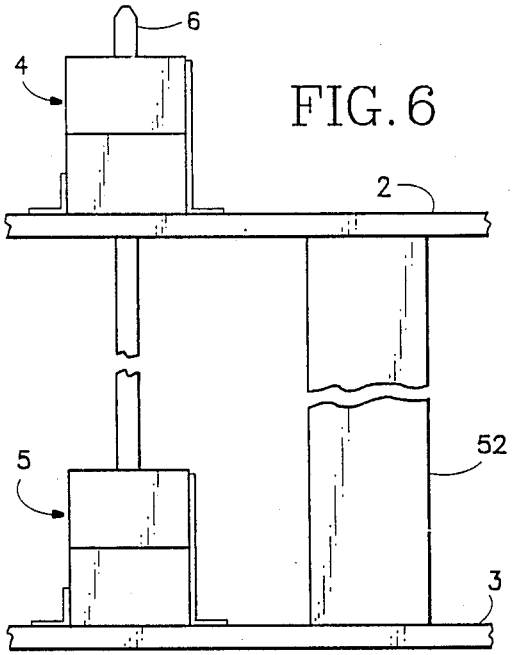
FIGS. 6, 7 and 8 illustrate schematically different use environments for the FIG. 1 connector.
Figure 8B:
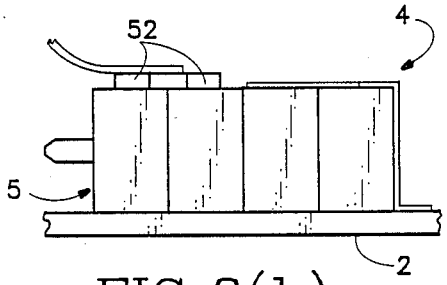
Figure 7:
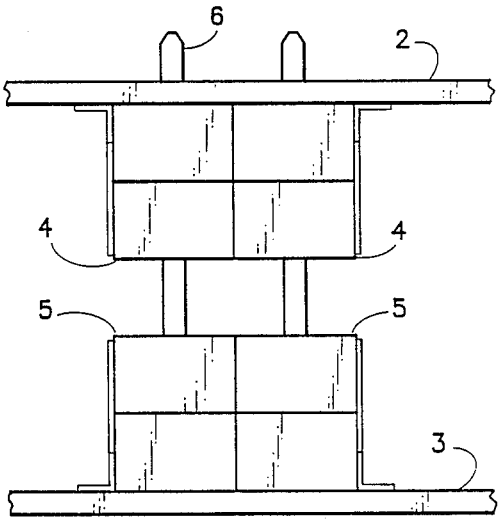
Figure 8A:
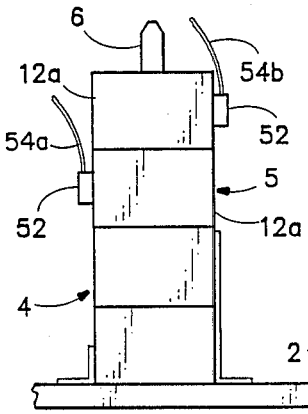

The boards 2 and 3 shown in FIG. 1 are mounted face-to-face and are spaced at double the height of a single connector component. FIG. 6 shows an arrangement, using longer rods, in which the boards are mounted at a greater distance by use of a dielectric stand-off structure 52. FIG. 7 shows a further arrangement in which two pairs of connector components as shown in FIG. 2 are used for connecting the conductor runs of two circuit boards. In the case of FIG. 7, the legs 30 of each connector component are provided on the same side of that component instead of on opposite sides as shown in FIGS. 2 and 3. FIG. 8 shows two arrangements in which a connector of the kind shown in FIG. 1 is used to connect the conductor runs of a circuit board to ribbon cable(s). In FIG. 8(*a*), the legs 30 and pads 24 of the connector component 5 are replaced by tabs 52. The tabs are in two groups, carried by the bodies 12*a* and 12*b* respectively, and the tabs in each group are at a pitch of 1.27 mm. Two ribbon cables 54*a* and 54*b*, each having their conductors at 1.27 mm centers, are connected to the two groups of tabs respectively. In FIG. 8(b), the two groups of tabs are at the same side of the component 5 and a single ribbon cable having its conductors at 0.635 mm centers is connected to both groups of tabs.

Figure 9:
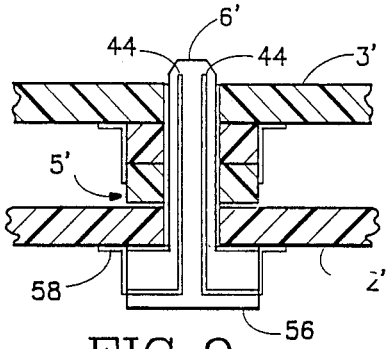
FIGS. 9 and 10 illustrate, partly in section, end views of respective modifications of the FIG. 4 connector.
Figure 10:
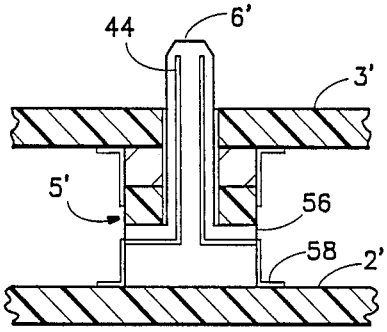

In the case of the connector shown in FIG. 1, the rods 6 are not physically attached to either circuit board. FIGS. 9 and 10 illustrate two modifications of the FIG. 1 connector in which the rods 6′ are attached to a circuit board. In the case of FIG. 9, the rod 6′ is attached to a surface mount block 56 having contact pads 58. The pins 44 are electrically connected to the pads 58, for example through conductors that extend through channels in the block 56. The surface mount block 56 is attached to a circuit board 2′ by soldering the pads 58 to conductor runs of the circuit board. The rod 6′ then projects through the board and is received in a connector component 5′, which is attached to a second circuit board 3′. In the case of FIG. 10, the surface mount block 56 is configured so that it is not necessary for the rod 6′ to extend through the circuit board 2′. In FIG. 10 also, the pins 44 are connected to the pads 58 by means of conductors that lie in channels extending through the surface mount block 56. The conductors may cross within the block 56, so that the relative positions of the pads 58 need not correspond to those of the pins 44.

Figure 12:
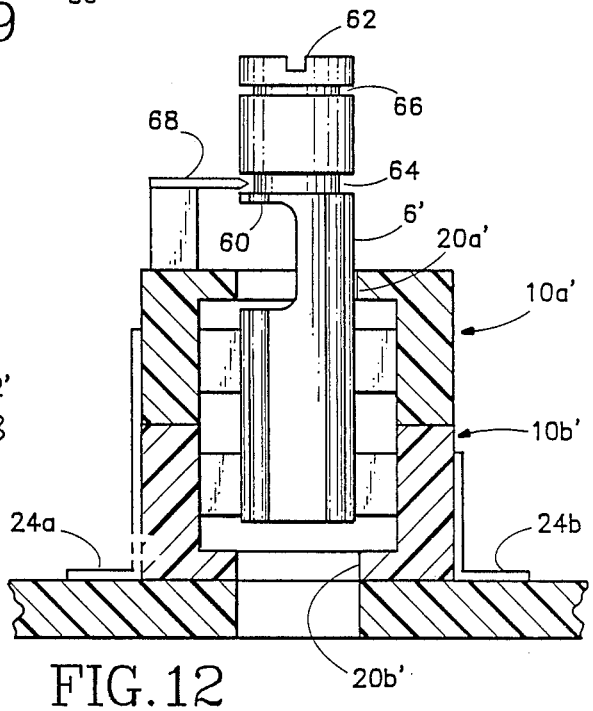
FIG. 12 is a sectional view taken on the line XII—XII of FIG. 11.
Figure 11:
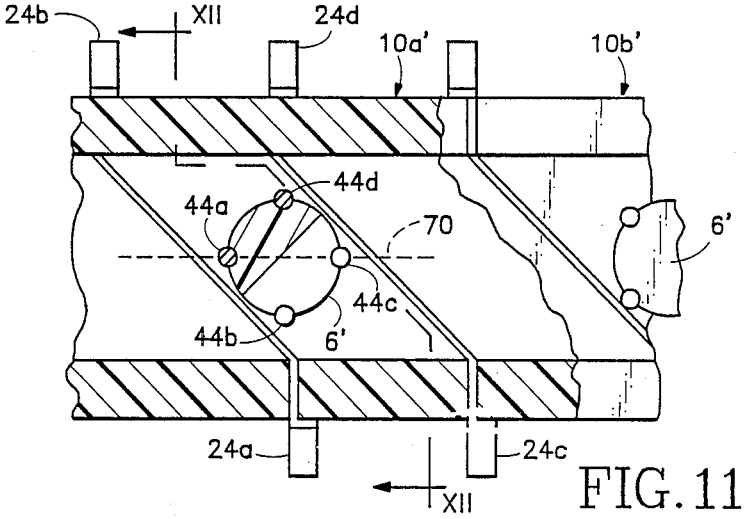
FIG. 11 is a fragmentary sectional view of a further modified form of the FIG. 1 connector.

FIGS. 11 and 12 illustrates a connector allowing selective connection between a blade of the connector assembly 10*a*′ and a blade of the connector assembly 10*b*.′ The blades of the connector assembly 10*b*′ are parallel to the blades of the connector assembly 10*a*′, instead of being in crossing relationship therewith, and the holes 20′ are round and are sufficiently large to allow the rod 6′ to rotate. The rod 6′ is cut away over part of its length, as shown at 60′ so as to interrupt the pins 44*b* and 44*c*. The rod is provided with a screw head 62, for rotating the rod. The rod 6′ is also provided with two peripheral grooves 64 and 66, and the connector assembly 10*a*′ carries a resilient detent element 68 that engages one or other of these grooves depending on the longitudinal position of the rod relative to the connector assemblies. If the detent element is in engagement with the groove 64, it can be caused to engage the groove 66 by pressing the rod longitudinally; and the detent element can be brought back into engagement with the groove 64 by pulling the rod in the opposite longitudinal direction.

The blades of the two connector assemblies 10*a*′ and 10*b*′ and the pins of the rod 6′ establish a pair of switches. When the rod 6′ is in its upper center position (detent element engaging the groove 64 and the plane 70 in which the axes of the pins 44*a* and 44*c* lie parallel to the side walls), the pins 44 do not contact any of the blades of either of the connector assemblies, and therefore the pad 24*a* is electrically isolated from the pad 24*b* and the pad 24*c* is electrically isolated from the pad 24*d*. If the rod is then rotated 45 degrees in the clockwise sense seen in FIG. 11, the pin 44*b* provides electrical contact between the pads 24*a* and 24*b* and the pin 44*d* provides electrical contact between the pads 24*c* and 24*d*. Similarily, if the rod had been rotated 45 degrees in the counter-clockwise sense, the pins 44*a* and 44*c* would have provided electrical contact between, respectively, the pads 24*a* and 24*b* and the pads 24*c* and 24*d*. If the rod 6′ is placed in its lower center position, the pads 24*a* and 24*c* are again isolated from the pads 24*b* and 24*d* respectively. If the rod is rotated 45 degrees in the clockwise sense, the pin 44*d* connects the pads 24*c* and 24*d* but the pads 24*a* and 24b remain isolated because the cutaway 60 in the rod results in no contact being made between the pin 44*b* and the blade connected to the pad 24*a*. If the rod had been rotated 45 degrees in the counterclockwise sense, the pin 44*a* would have connected the pads 24*a* and 24*b* and the pads 24*c* and 24*d* would have remained isolated. Thus, the modified connector functions as a switch, allowing the connection between the pads 24*a* and 24*b* to be established and broken independently of the establishing and breaking of the connection between the pads 24*c* and 24*d*.

The three-pad connector shown in FIGS. 13–16 comprises two housings 102 and 140 made of dielectric material, such as injection-molded synthetic polymer material. Each of the housings 102, 140 has a base 104 and walls 106. The base 104 and the walls 106 define a cavity 108 which is generally rectangular in section. Pins 110 (FIG. 14) are embedded in the base 104 of each housing 102, 140. The pins 110 are made of metal and each has a foot 112 and a leg 114. The legs 114 extend parallel to one another in the cavity 108. In the illustrated embodiment, there are sixteen pins arranged in two spaced parallel rows of eight pins each. The legs of the pins are uniformly spaced within each row, and the space between the rows is equal to the space between the legs in each row. Accordingly, four groups of four legs are formed, with the centers of the legs in each group being at the corners of a square. The four groups are at a pitch of 2.54 mm.

Figure 13:
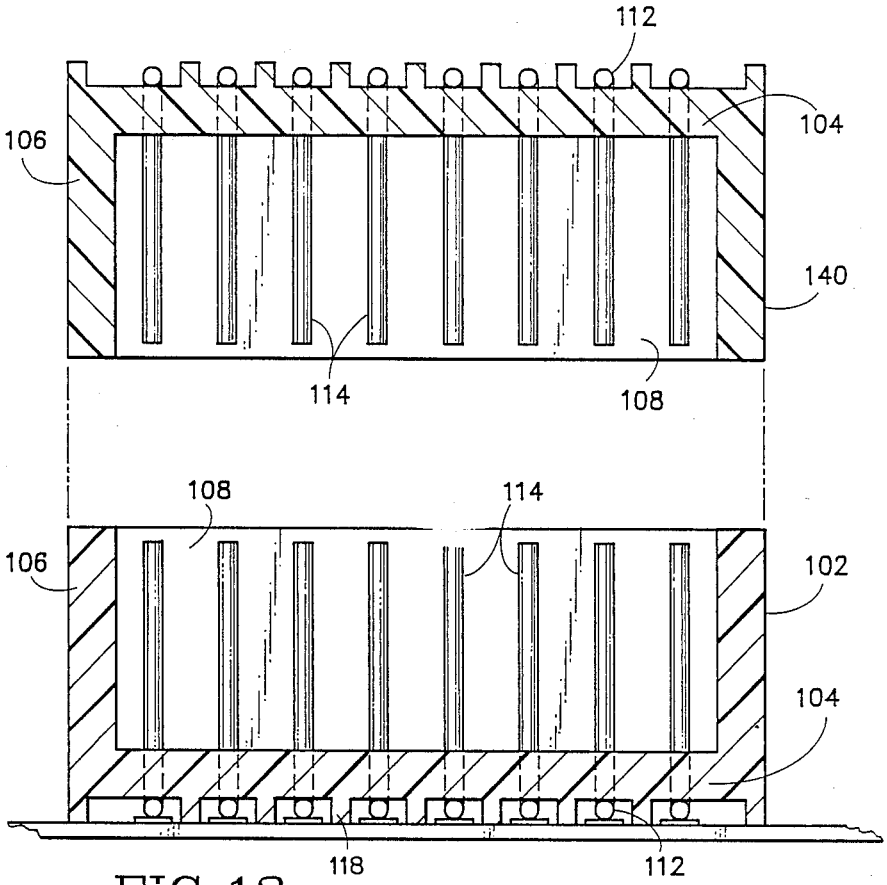
FIG. 13 is a sectional view of two parts of a three-part connector embodying the present invention.
Figure 14:
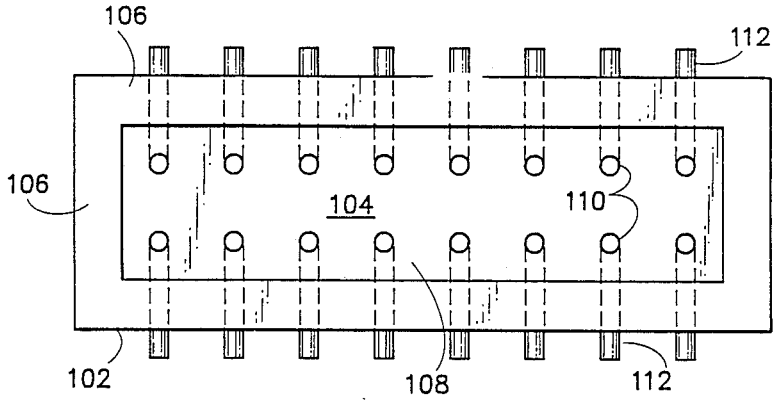
FIG. 14 is a plan view of one of the parts shown in FIG. 13.

Each pin extends through the base 104 and its foot 112 extends perpendicular to the leg 114 and lies on the opposite side of the base from the cavity 108. The feet of each set of eight pins extend parallel to each other. The housing 102 is shown in FIG. 13 as being mounted on a circuit board with the feet 112 soldered to conductor runs of the circuit board. Ribs 118 are provided on the lower surface of the base 104 to prevent solder bridging.

Figure 15:
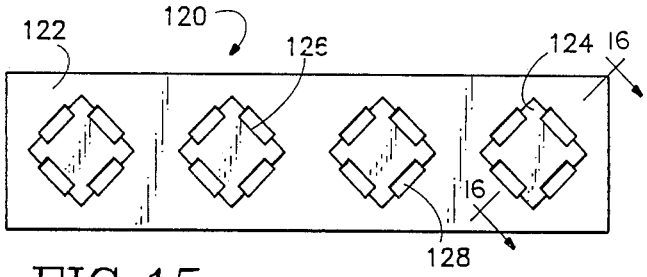
FIG. 15 is a plan view of the third part of the three-part connector.

The three-part connector further comprises an interconnect assembly 120 (FIG. 15). The interconnect assembly comprises a plate 122 which is made of dielectric material, such as injection-molded synthetic polymer material, and is sized and shaped to fit in the cavity 108 above the legs 114. Eight posts 124 project from the plate 122 in two sets of four, at opposite sides of the plate respectively. The posts 124 are integral with the plate 122. Each set of four posts in in a linear array at a pitch of 2.54 mm.

Each post is generally square in cross-section, but is formed in each side with a channel-shaped recess 126.

The sides of each post 124 are at 45° to the line joining the central axes of the post. Each post 124 is axially aligned with a corresponding post on the opposite side of the plate 122, and the recesses in each two corresponding posts are mutually aligned. The plate 122 is formed with rectangular holes 128 which provide communication between respective pairs of aligned recesses 126. Metal blades 130 (FIG. 16) extend through the holes 128 respectively. Each blade 130 has a major portion 132 which lies in the recesses that communicate by way of the hole 128, and two end portions 136 which are folded forward over the major portion 132. The free ends 134 of the two end portions 136 are spaced apart by a distance which is slightly greater than the thickness of the plate 122. The blades are folded in the manner described above before insertion through the holes 128. The metal of the blades is resilient, and therefore the free ends 134 of the end portions 136 spring away from the major portion 132 after the blades are inserted. Accordingly engagement of the free ends 134 with the plate 122 presents inadvertent removal of the blade from its hole 128.

The plate 122 is fitted in the cavity 108 of the connector housing 102 with each post of one set inserted among the legs 114 of one group of pins. One end portion of each blade then engages a corresponding pin 110. The second connector housing 140, which may have the feet of its connector pins connected to conductor runs of another circuit board or to a multiple-conductor cable, is fitted over the posts of the second set, and the end portions of the blades engage respective pins of the connector housing 140. In this way, electrical connection is established between the pins of the housing 102 and the pins of the second connector housing 140.

Preferably, the end portions 136 of the blades 130 are creased longitudinally so as to have a V-shaped cross-section, with the base 137 of the V towards the portion 132, in order to increase the contact area between the blades 130 and the pins 110. In order to facilitate creasing of the portions 136, the portion 132 also may be creased in similar fashion, in which case it is preferred that bases of the recesses 126 and the corresponding surfaces of the holes 128 be V-shaped in order to conform more closely to the shape of the portion 132.

Figure 15A:
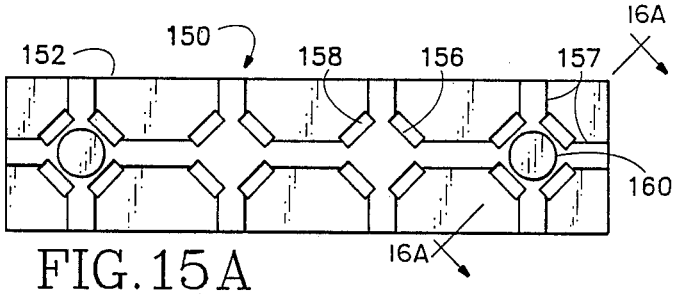
FIG. 15A is a plan view of a part that may be used with one of the parts shown in FIG. 13 to provide a two-part connector.
Figure 16:
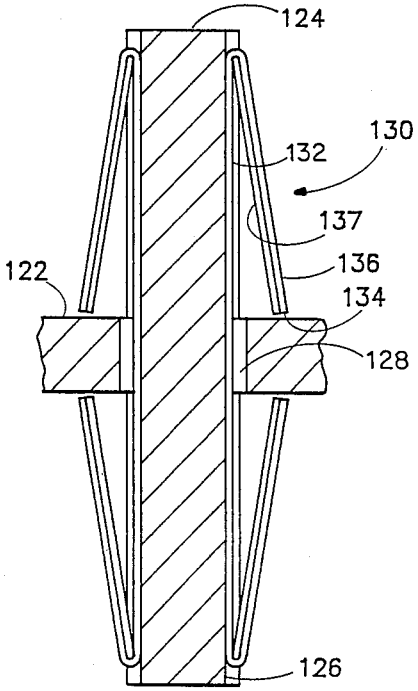
FIGS. 16 and 16A are sectional views taken on three lines 16—16 and 16A—16A of FIGS. 15 and 15A respectively.
Figure 16A:
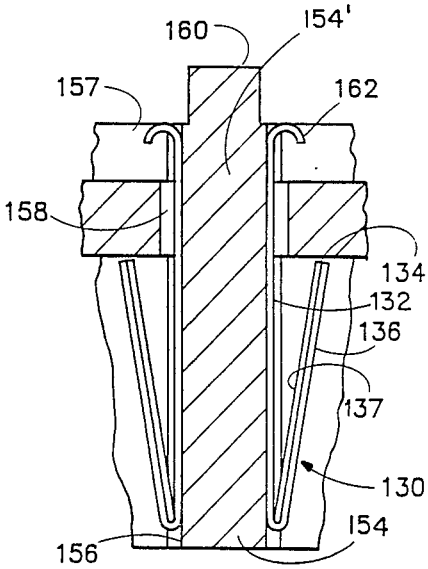

The two-part connector comprises just one housing 102 and an interconnect assembly 150 as shown in FIGS. 15A and 16A. The posts 154 that project below the plate 152 and are fitted in the housing 102, in the manner described with reference to FIGS. 13–16, are longer than the posts 154' that project above the plate 152. The posts 154, 154' are formed by the intersections of ribs 157, which are provided in order to minimize the danger of short circuits between the blades 130. Only the lower end portions 136 of the blades 130 shown in FIG. 16A are folded over the major portion 132 of the blade. The upper end portion 162 is bent in order to provide a J-type terminal which may be soldered directly to a terminal of an electrical component or circuit board. Two of the posts 154' are formed with alignment bosses 160 which enter alignment holes in the electrical component.

It will be appreciated that the present invention is not restricted to the particular electrical connectors that have been described and illustrated, and that variations may be made therein without departing from the scope of the invention as defined in the appended claims and equivalents thereof. In particular, the invention is not limited to the rods 6 or the post 124 being at a pitch of 2.54 mm, or to each housing of the connectors of FIGS. 13–16A having four groups of pins. The rod 6 of the FIGS. 1–5 connector might not have four pins. For example, the rod may have eight pins, with the axes of the pins equiangularly spaced about the central axis of the rod. In this case, each connector component would comprise a stack of four connector assemblies, and the rod would be twisted about its central axis through 45 degrees at a location between the blades of one pair of connector assemblies and the blades of the other pair of connector assemblies. Further, the invention is not restricted to the conductive material of the rod being in the form of a pin that is sufficiently siff to be self-supporting. For example, the core of dielectric material may have a surface layer of metal adhered thereto, and portions of the metal may be removed by selective etching in order to provide strips extending longitudinally of the rod. A pair of adjacent blades may be replaced by a block of dielectric material having strips of conductive material adhered to opposite respective sides thereof. It is not essential that the bodies 12 be in base-to-base relationship as shown in FIG. 2, since the relationship between the blades **22*a* and the blades 22*b* is preserved if the bodies 12 are in channel-to-channel relationship as shown in FIG. 12**.

We claim:

1. An electrical connector comprising:

at least four conductor elements each having a surface portion which is spaced from, but presented towards, a first axis, said surface portions being angularly spaced about said first axis and substantially equidistant therefrom and each extending at least partly between first and second planes which are perpendicular to said first axis, and a rod structure having a central axis, the rod structure comprising at least four elongate bodies of conductive material which are supported in mutually electrically insulated relationship, said bodies being substantially parallel to each other and angularly spaced about the central axis of the rod structure and substantially equidistant therefrom, the rod structure being positioned so that it extends through said first and second planes and its central axis substantially coincides with said first axis, the rod structure being held against rotation relative to the conductor elements about said first axis and the bodies of conductive material engaging the surface portions of the conductor elements respectively.

2. A connector according to claim 1, wherein the four conductor elements comprise respective metallic pins which extend parallel to one another and the bodies of conductive material comprise respective blades of metal.

3. A connector according to claim 2, wherein the bodies of conductive material are supported by a post of dielectric material which is substantially square in cross-section, having four major sides, each side of the post being formed with a longitudinal recess in which one of the bodies of conductive material is fitted.

4. A connector according to claim 2, comprising a housing which is made of dielectric material and has a base, said pins being embedded in said base and each having a leg portion which projects from one side of the base and a foot portion which projects from an opposite side of the base.

5. A connector according to claim 1, comprising a dielectric member which defines a passageway having a central axis which coincides with said first axis, and wherein the rod structure comprises an elongate core of dielectric material, said bodies of conductive material being secured to and extending lengthwise of the core.

6. A connector according to claim 5, wherein the dielectric member has a base and two opposite side walls, whereby an elongate channel is defined, the passageway is defined by a hole in the base of the dielectric member and extend perpendicular to the longitudinal axis of the channel, and two of the conductor elements comprise respective blades of metal that extend diagonally across the channel, the blades of metal being parallel to one another and in confronting relationship across said passageway.

7. A connector according to claim 2, wherein each blade comprises first and second portions, the first portion being between the second portion and the central axis of the rod structure, and wherein the second portion is folded longitudinally so that it is convex towards the first portion.

8. An electrical connector comprising:

a group of at least two pin-like conductor elements supported in mutually electrically insulated relationship so that they extend parallel to a first axis over at least part of the distance between first and second planes which are perpendicular to said first axis, the conductor elements each having a surface portion which is spaced from, but presented towards, said first axis, said surface portions being substantially equiangularly distributed about said first axis and substantially equidistant therefrom, and a rod structure having a central axis, said rod structure comprising a plurality of blade-like bodies of conductive material supported in mutually electrically insulated relationship, the number of bodies of conductive material being equal to the number of conductor elements and said bodies being substantially equiangularly distributed about the central axis of the rod structure and substantially equidistant therefrom, the rod structure and the conductor elements being positionable so that the central axis of the rod structure substantially coincides with said first axis, and being such that when they are so positioned and the rod structure extends through said first and second planes, the bodies of conductive material engage the surface portions of the conductor elements respectively.

9. A connector according to claim 8, wherein the conductor elements are supported by a first body of dielectric material and the connector further comprises a second body of dielectric material, a second group of at least two pin-like conductor elements supported by the second body of dielectric material so that they extend parallel to a third axis over at least part of the distance between third and fourth planes which are perpendicular to said third axis, the number of conductor elements in the second group being equal to the number of conductor elements in the first-mentioned group, the conductor elements of the second group each having a surface portion which is spaced from, but presented towards, said third axis, said surface portions of the conductor elements of the second group being substantially equiangularly distributed about said third axis and substantially equidistant therefrom, so that when the bodies of dielectric material and the rod structure are positioned so that said central axis substantially coincides with both the first axis and the third axis and a first end of the rod structure extends through said first and second planes and a second end of the rod structure extends through said third and fourth planes, electrically-conductive connection is established between the conductor elements of the first-mentioned group and respective conductor elements of the second group.

10. A connector according to claim 9, wherein the bodies of conductive material are supported by a plate of dielectric material and first and second posts of dielectric material which are mutually aligned and project from the plate in opposite respective directions, each post being formed with recesses which receive the bodies of conductive material respectively.

11. A connector according to claim 10, wherein the plate is formed with holes through which the bodies of conductive material respectively extend.

12. A connector according to claim 11, wherein each blade-like body of conductive material has a major portion which extends through a hole in the plate and lies in recesses in the first and second posts respectively, and two minor portions which overlie the major portion at opposite respective sides of the plate, the minor portions having respective free ends which are spaced from each other by a distance that is slightly greater than the thickness of the plate.

13. A connector according to claim 12, wherein the minor portion of each blade-like body is folded longitudinally so that it is convex towards the central axis of the rod structure.

14. An electrical connector comprising means defining a passageway, first and second conductor elements each having a surface portion that is spaced from, but presented towards, the central axis of the passageway, said surface portions of the first and second conductor elements being spaced apart along said central axis, third and fourth conductor elements each having a surface portion that is spaced from, but presented towards, the central axis of the passageway, said surface portions of the third and fourth conductor elements being spaced apart along said central axis, and a composite rod that can be inserted into the passageway along the central axis of the passageway, the rod comprising an elongate core of dielectric material and at least two elongate bodies of conductive material secured to and extending lengthwise of the core, the bodies of conductive material being angularly spaced about the central axis of the core, and each being of restricted peripheral extent about the rod, and a first of said bodies of conductive material being shorter than a second of said bodies of conductive material so that when the rod is fitted in the passageway and is in a first longitudinal position, the rod can be placed selectively either in a first rotational position in which the second body of conductive material engages said surface portions of the first and second conductor elements and provides electrical connection therebetween while the third and fourth conductor elements remain mutually electrically isolated, or in a second rotational position in which the second body of conductive material engages said surface portions of the third and fourth conductive elements and provides electrical connection therebetween while the first and second conductor elements remain mutually electrically isolated, the rod having a second longitudinal position such that in one rotational position of the rod the first and second conductor elements are connected by one of the bodies of conductive material and the third and fourth conductor elements are connected by another body of conductive material and in another rotational position of the rod both the first and second conductor elements and the third and fourth conductor elements are mutually electrically isolated.

15. A connector according to claim 14, wherein the composite rod comprises at least four elongate bodies of conductive material secured to and extending lengthwise of the core, the bodies of conductive material being angularly spaced about the central axis of the core and each being of restricted peripheral extent about the core, and a first two of said bodies of conductive material being shorter than a second two of said bodies of conductive material.

16. An electrical connector comprising:

a dielectric member having a base and two opposite side walls, whereby an elongate channel is defined, the base of the dielectric member being formed with a hole that defines a passageway having a central axis perpendicular to the longitudinal axis of the channel.

at least four conductor elements each having a surface portion which is spaced from, but presented towards, a first axis that coincides with said central axis, said surface portions being substantially equiangularly distributed about said first axis and substantially equidistant therefrom and each extending at least partly between first and second planes which are perpendicular to said first axis, two of the conductor elements comprising respective blades of metal that extend diagonally across the channel, the blades of metal being parallel to one another and in confronting relationship across said passageway, and a rod structure having a central axis, the rod structure comprising an elongate core of dielectric material and at least four elongate bodies of conductive material which extend lengthwise of the core and are secured to the core in mutually electrically insulated relationship, said bodies being substantially parallel to each other and substantially equiangularly distributed about the central axis of the rod structure and substantially equidistant therefrom, the rod structure and the conductor elements being positionable so that the central axis of the rod structure substantially coincides with said first axis, and being such that when they are so positioned and the rod structure extends through said first and second planes, the bodies of conductive material engage the surface portions of the conductor elements respectively.

17. A connector according to claim 16, wherein the rod structure is held against rotation relative to the conductor elements.

18. An electrical connector comprising:

four metallic pins extending parallel to each other and each having a surface portion which is spaced from, but presented towards, a first axis, said surface portions being substantially equiangularly distributed about said first axis and substantially equidistant therefrom and each extending at least partly between first and second planes which are perpendicular to said first axis, and a rod structure having a central axis, the rod structure comprising a post of dielectric material which is substantially square in cross-section, having four major sides, each side of the post being formed with a longitudinal recess, and four metallic blades which are fitted in the recesses respectively and are in mutually electrically insulated relationship, the rod structure and the metallic pins being positionable so that the central axis of the rod structure substantially coincides with said first axis, and being such that when they are so positioned and the rod structure extends through said first and second planes, the metallic pins engage the surface portions of the metallic blades respectively.

19. A connector according to claim 18, wherein each blade comprises first and second portions, the first portion being between the second portion and the central axis of the rod structure, and wherein the second portion is folded longitudinally so that it is convex towards the first portion.

* * * * *